US010682022B2

(12) United States Patent
Granger

(10) Patent No.: US 10,682,022 B2
(45) Date of Patent: Jun. 16, 2020

(54) PRECUT WIPING MATERIAL DISPENSER, METHOD FOR IMPLEMENTING AND METHOD FOR ADJUSTING SUCH A DISPENSER

(71) Applicant: Maurice Granger, Albufeira (PT)

(72) Inventor: Maurice Granger, Albufeira (PT)

( * ) Notice: Subject to any disclaimer, the term of this patent is extended or adjusted under 35 U.S.C. 154(b) by 176 days.

(21) Appl. No.: 16/080,457

(22) PCT Filed: Apr. 10, 2017

(86) PCT No.: PCT/FR2017/050855
§ 371 (c)(1),
(2) Date: Aug. 28, 2018

(87) PCT Pub. No.: WO2017/187041
PCT Pub. Date: Nov. 2, 2017

(65) Prior Publication Data

US 2019/0059660 A1 Feb. 28, 2019

(30) Foreign Application Priority Data

Apr. 27, 2016 (FR) ..... 16 53708

(51) Int. Cl.
*A47K 10/38* (2006.01)
*A47K 10/34* (2006.01)

(52) U.S. Cl.
CPC ..... *A47K 10/38* (2013.01); *A47K 10/34* (2013.01)

(58) Field of Classification Search
CPC ..... A47K 10/32; A47K 10/38; A47K 10/34; A47K 10/424; A47K 2010/3233; A47K 2010/3675
See application file for complete search history.

(56) References Cited

U.S. PATENT DOCUMENTS 2,193,759 A * 3/1940 Birr ..... A47K 10/3643 225/8
4,467,974 A * 8/1984 Crim ..... A47K 10/3809 242/419.4

(Continued)

FOREIGN PATENT DOCUMENTS

FR 2960760 12/2011
FR 2966034 4/2012

(Continued)

OTHER PUBLICATIONS

International Search Report (English) and Written Opinion dated Jul. 7, 2017, from International Application No. PCT/FR2017/050855, 12 pages.

*Primary Examiner* — William A. Rivera
(74) *Attorney, Agent, or Firm* — Meunier Carlin & Curfman LLC

(57) ABSTRACT

The present invention concerns a dispenser for dispensing precut wiping material, in the form of a reel that can be unwound as a strip. The dispenser comprises a housing, a cover and a module. The module comprises two side walls, a guide device, a flap and a plate. A space for guiding and clamping the strip is delimited between the flap and the plate. The module comprises a system providing relative clearance between the flap and the plate, varying the configuration of said space. The clearance system comprises four transverse rods formed projecting from the side edges of the flap, with two spaced-apart rods per side edge, and four housings provided in the side walls, with two housings per side wall. Each housing receives one of the rods and comprises a longitudinal part and a vertical part. A clearance is thus defined longitudinally and vertically between each rod and the corresponding housing.

10 Claims, 6 Drawing Sheets

(56) References Cited

U.S. PATENT DOCUMENTS

| | | | | |
|---|---|---|---|---|
| 9,375,117 | B2 * | 6/2016 | Granger | A47K 10/34 |
| 9,402,512 | B2 * | 8/2016 | Granger | A47K 10/38 |
| 2011/0089213 | A1 * | 4/2011 | Granger | A47K 10/426<br>225/106 |
| 2013/0075417 | A1 * | 3/2013 | Granger | A47K 10/32<br>221/45 |
| 2013/0256450 | A1 * | 10/2013 | Granger | A47K 10/34<br>242/590 |
| 2013/0320132 | A1 * | 12/2013 | Granger | A47K 10/34<br>242/590 |
| 2013/0334272 | A1 * | 12/2013 | Granger | A47K 10/3827<br>225/15 |

FOREIGN PATENT DOCUMENTS

| | | |
|---|---|---|
| FR | 2986957 | 6/2012 |
| FR | 2970167 | 7/2012 |
| FR | 2992542 | 1/2014 |
| WO | 2012/076776 | 6/2012 |
| WO | 2014/041267 | 3/2014 |

* cited by examiner

PRECUT WIPING MATERIAL DISPENSER, METHOD FOR IMPLEMENTING AND METHOD FOR ADJUSTING SUCH A DISPENSER

BACKGROUND

The present invention concerns a dispenser for precut wiping material. The invention also concerns a method of implementing and a method of adjusting such a dispenser.

The field of the invention is that of devices for dispensing wiping material such as hand towels, paper towels, toilet paper or similar products, precut in a specific format. The material can be paper, cellulose wadding or any other material suitable for the intended application. The material is positioned in the dispenser in the form of a reel. A strip of material is unwound from the reel, then guided outside of the device in order to be accessible to a user.

The Applicant has already designed numerous devices in this field, such as those described in the documents FR2960760, FR2966034, FR2968530, FR2986957, FR2992542 and FR2995520.

SUMMARY

The purpose of the present invention is to improve the existing devices.

To that end, an object of the invention is a dispenser of precut wiping material, in the form of a reel that can be unwound as a strip, the dispenser comprising: a housing, a cover that is movable relative to the housing between an open position and a closed position, and a module received within the housing; the module is partially covered by the cover in the closed position, and delimits an outlet passage for the strip of material; and the module comprises:

- two side walls parallel to each other, between which the reel is positioned,
- a guiding device for guiding the strip unwound from the reel,
- a flap disposed transversely between the side walls, having two side edges that extend facing the side walls, and a front surface comprising a rainbow-shaped profile consisting of ridges and troughs each extending along an arc on the front surface, and
- a plate disposed transversely in front of the flap, movable relative to the side walls between a lowered position and a raised position, and having a rear surface comprising a rainbow-shaped profile consisting of ridges and troughs each extending along an arc on the front surface;

the rainbow-shaped profile of the flap and the rainbow-shaped profile of the plate being complementary so that the ridges of the flap are received in the troughs of the plate and the ridges of the plate are received in the troughs of the flap when the plate is in the raised position;

the flap and the plate thus delimiting between them a space for guiding and clamping the strip, having a variable configuration, and situated immediately upstream from the outlet passage of the strip;

the module comprising a relative clearance system between the flap and the plate, varying the configuration of the space for guiding and clamping the strip, the clearance system comprising:

- four transverse rods formed projecting from the side edges of the flap, with two separated rods per side edge, and

- four receptacles made in the side walls of the module, with two receptacles per side wall, characterized in that each receptacle receives one of the rods of the flap and comprises a longitudinal part and a vertical part, a clearance being thus defined longitudinally and vertically between each rod and the corresponding receptacle.

Thus, the invention makes it possible to avoid the return backwards and rising of the strip of material caused by the swinging movement of the guiding device. Said swinging movement occurs when a user exerts a pulling force on the strip of material at the outlet passage. In practice, the greater the pulling force exerted by the user, the more pronounced said swinging movement is.

The clearance system makes it possible to temporarily narrow the space defined between the flap and the plate, and therefore temporarily increase the frictional forces exerted between the strip, the flap and the plate in said space, when a user pulls on the strip of material. First, the frictional forces are combined with the pulling force to separate a format from the strip. Moreover, said frictional forces prevent the strip from moving back up towards the reel.

Said clearance system is effective irrespective of the direction of the pulling force exerted by the user. The blocking against return of the strip is done in the space located just above the outlet passage, vertically from the gripping and pulling on the format consisting of the end of the strip.

The user no longer needs to look for the strip when it becomes inaccessible in the module, thus avoiding tedious manipulations. The invention thus offers greater ease-of-use. The invention is simple to implement and effective for all types of wiping materials, irrespective of the thickness of the material and the specific characteristics thereof.

According to other advantageous features of the invention, considered alone or in combination:

- The clearance system further comprises two springs disposed on each side of the module, each spring having an upper end hooked to one of the side walls and a lower end hooked to a rod received in a receptacle made in said side wall.
- The springs are positioned at an angle and exert a force tending to return the flap upward and forward, and thus vertically and longitudinally narrow the space defined between the flap and the plate.
- The springs are positioned longitudinally and exert a force tending to return the flap forward and thus longitudinally narrow the space defined between the flap and the plate.
- The springs are positioned vertically and exert a force tending to return the flap upward and thus vertically narrow the space defined between the flap and the plate.
- The clearance system comprises a spring positioned transversely and exerting a force tending to return the flap sideways and thus transversely narrow the space defined between the flap and the plate.
- The clearance system comprises an adjustment device for transverse position adjustment of the flap between the side walls, the adjustment device being actuatable by an operator.
- The adjustment device comprises a small plate pressing against one of the rods of the flap, and a screw that passes through the small plate and penetrates into one of the side walls of the module; screwing the screw into the side wall presses the small plate against the rod, moves the flap and transversely modifies the space defined between the flap and plate.

The adjustment device comprises: a thread formed on one of the rods of the flap, a bolt positioned on said rod, and a spring inserted between the bolt and one of the side edges of the module; a screwing of the bolt onto the rod compresses the spring, moves the rod and the flap, and transversely modifies the space defined between the flap and plate.

The module comprises a device for pulling the strip towards the outlet passage, through the space defined between the flap and the plate.

An object of the invention is also a method of implementing a dispenser such as the one mentioned above, characterized in that when a user exerts a pulling force on the strip of material near the outlet passage, then frictional forces are exerted between the strip, the flap and the plate in the space for guiding and clamping the strip; said frictional forces, in a first stage, combine with the pulling force to separate a format from the strip, then in a second stage, prevent the strip from moving back up.

An object of the invention is also a method of adjusting a dispenser such as the one mentioned above, characterized in that when an operator positions a new reel in the module, said reel having a thickness, a precut and/or a constituent material different from the preceding reel used in the dispenser, then the operator actuates the adjustment device to narrow or widen the space defined between the flap and the plate, and carries out different pulling tests of the strip at the outlet opening in order to define an optimal pulling force for the strip, said optimal pulling force being a function of the configuration of the space between the flap and the plate.

Generally, the actuating of the adjustment device and the pulling tests are iterative until a satisfactory pulling force is achieved.

BRIEF DESCRIPTION OF THE DRAWINGS

The invention will be better understood upon reading the following description, given solely as a non-limiting example, and made with reference to the accompanying figures in which.

DETAILED DESCRIPTION

Figure 1:
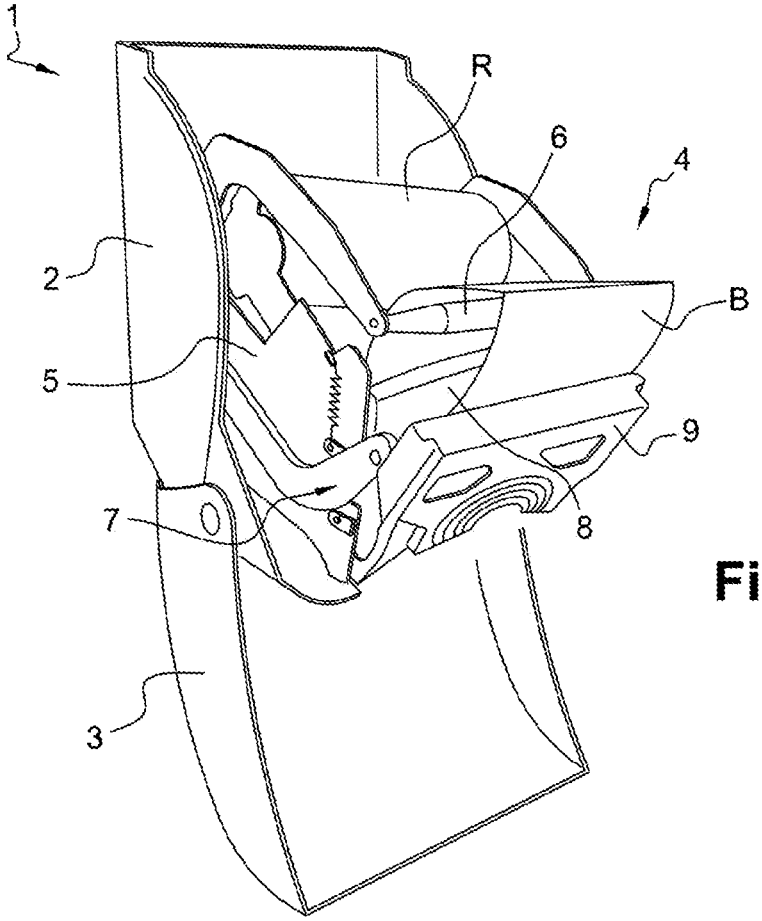
FIG. 1 is a perspective view of a dispenser according to the invention, comprising a housing, a cover shown in the open position, and a dispenser module, which comprises side walls, a flap and a front plate.
Figure 2:
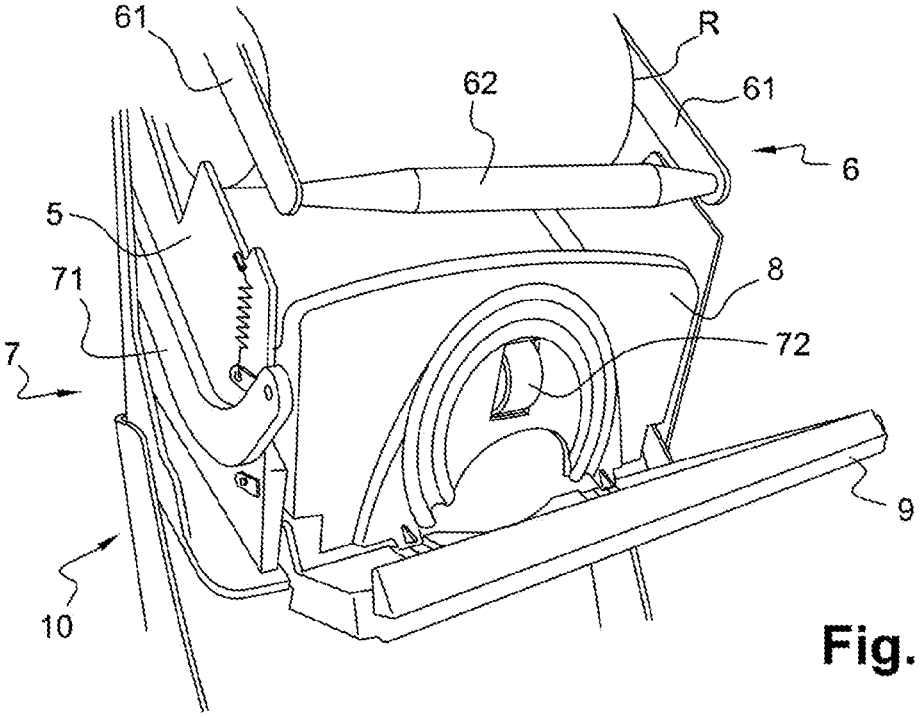
FIG. 2 is another perspective view of the dispenser, partially represented in larger scale, with the front plate lowered.
Figure 3:
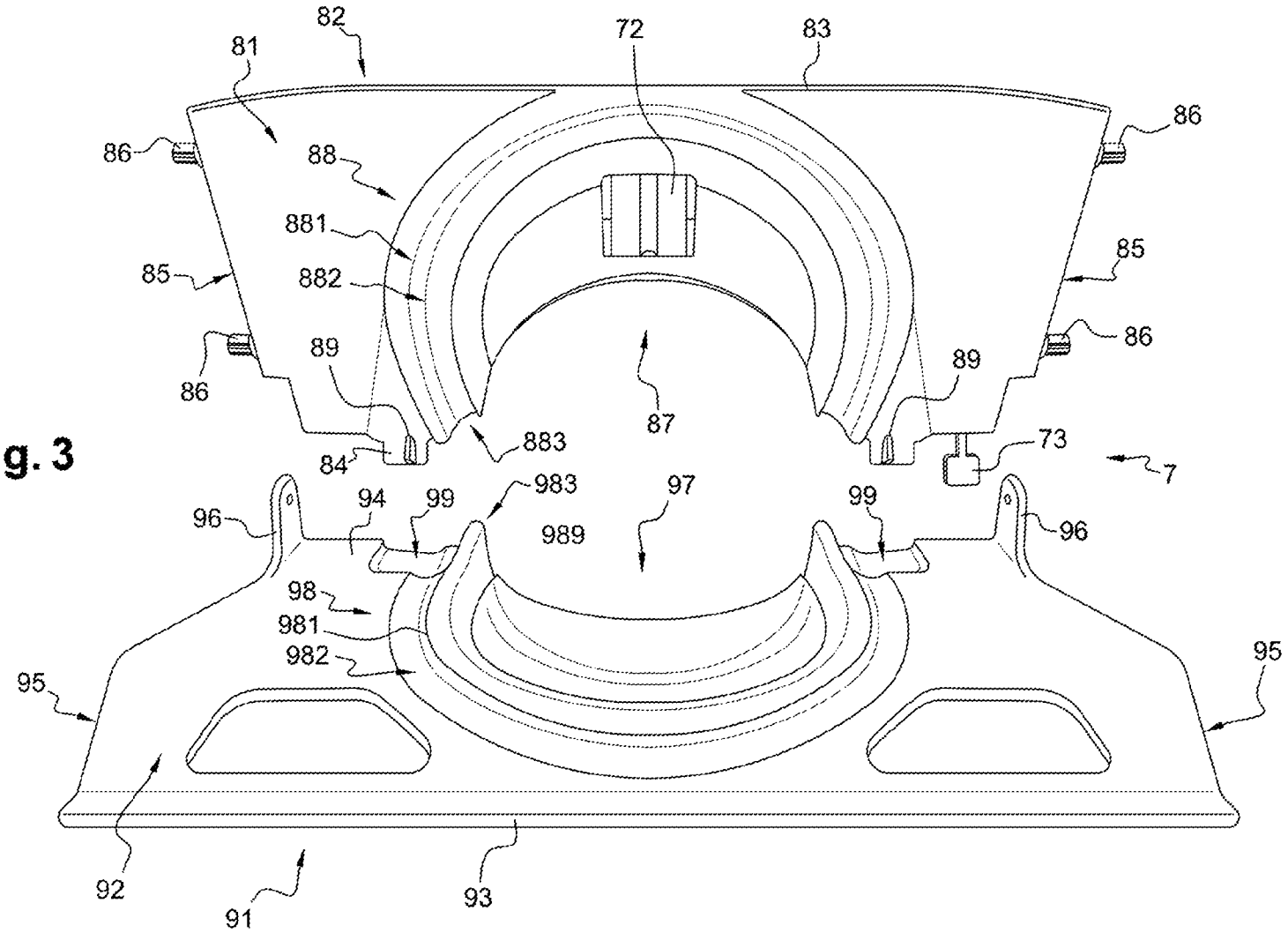
FIG. 3 is another perspective view, in larger scale, showing only the flap and the front plate disassembled.
Figure 4:
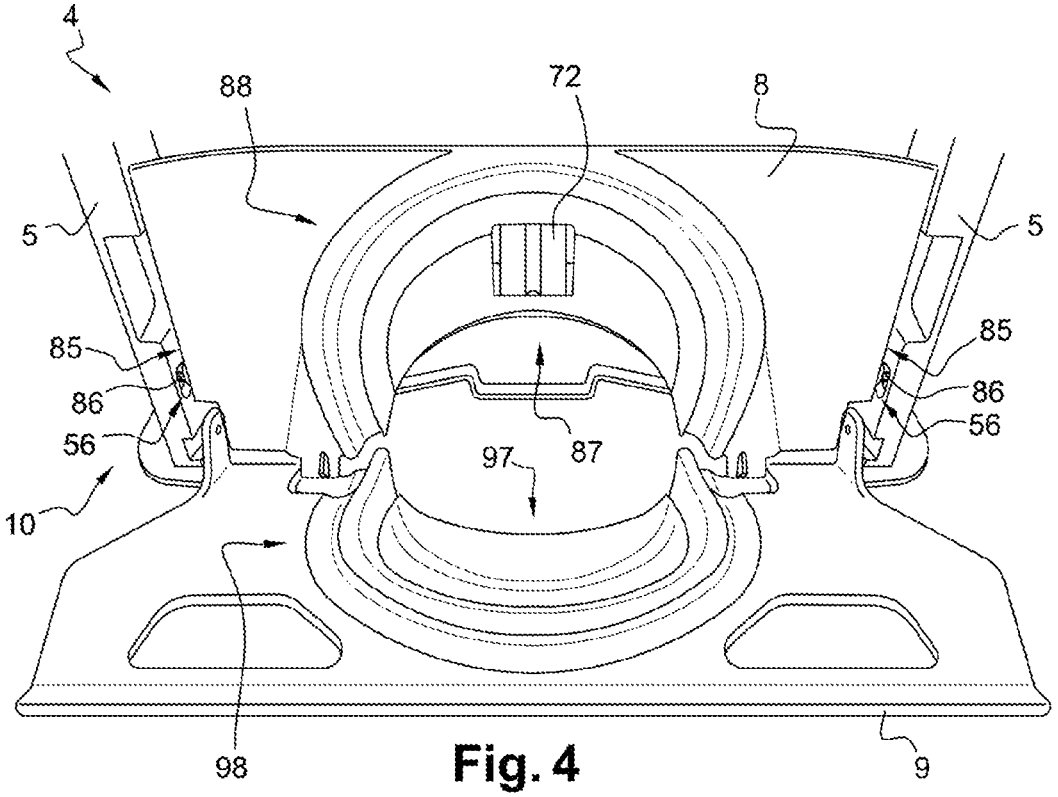
FIG. 4 is a perspective view similar to FIG. 3, in smaller scale, showing the flap and the front plate mounted between the side walls of the module.
Figure 5:
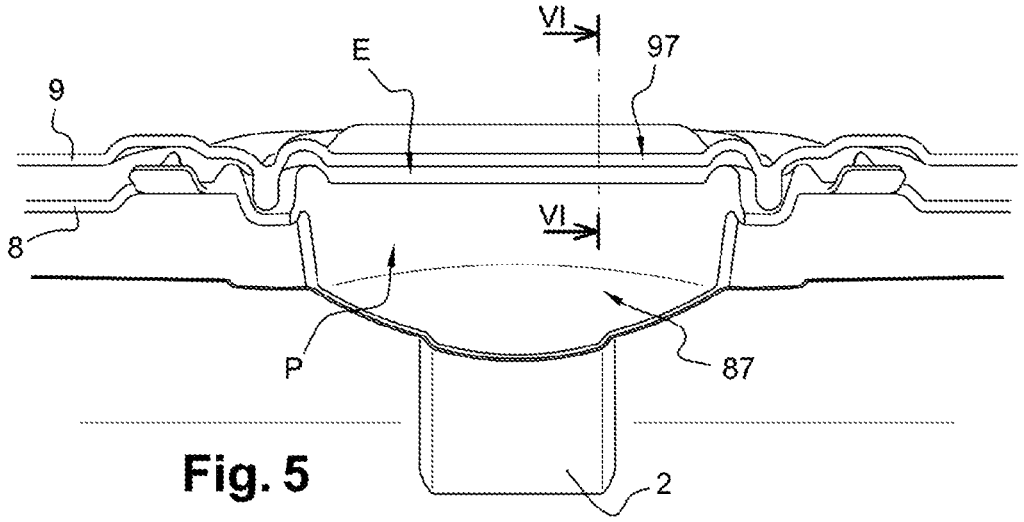
FIG. 5 is a bottom view of the module, partially represented in the front part thereof, showing the space between the flap and the raised front plate.
Figure 6:
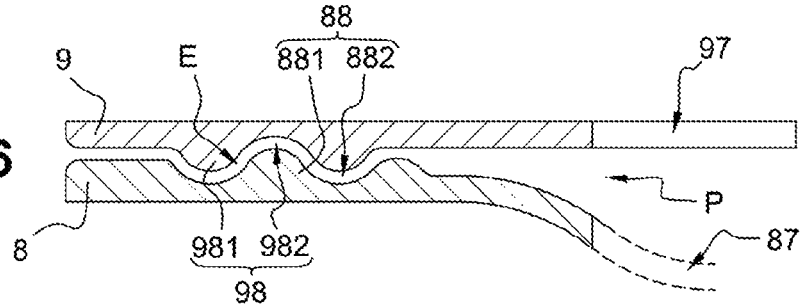
FIG. 6 is a cross-section along line VI-VI in FIG. 5.
Figure 8:
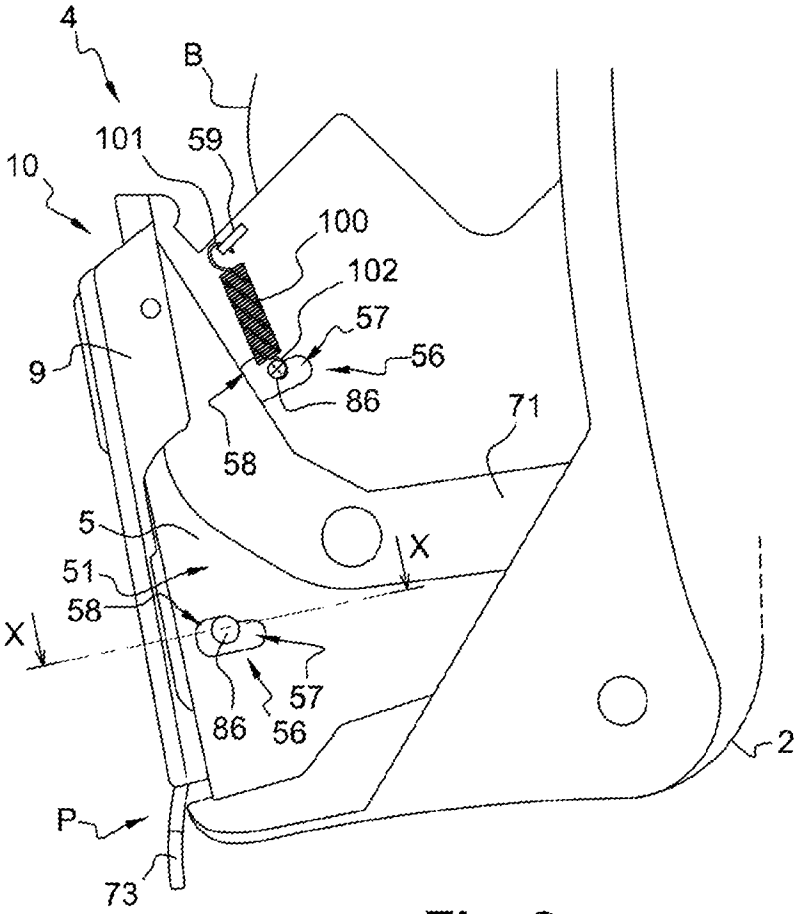
FIG. 8 is a left-side view of the dispenser.
Figure 7:
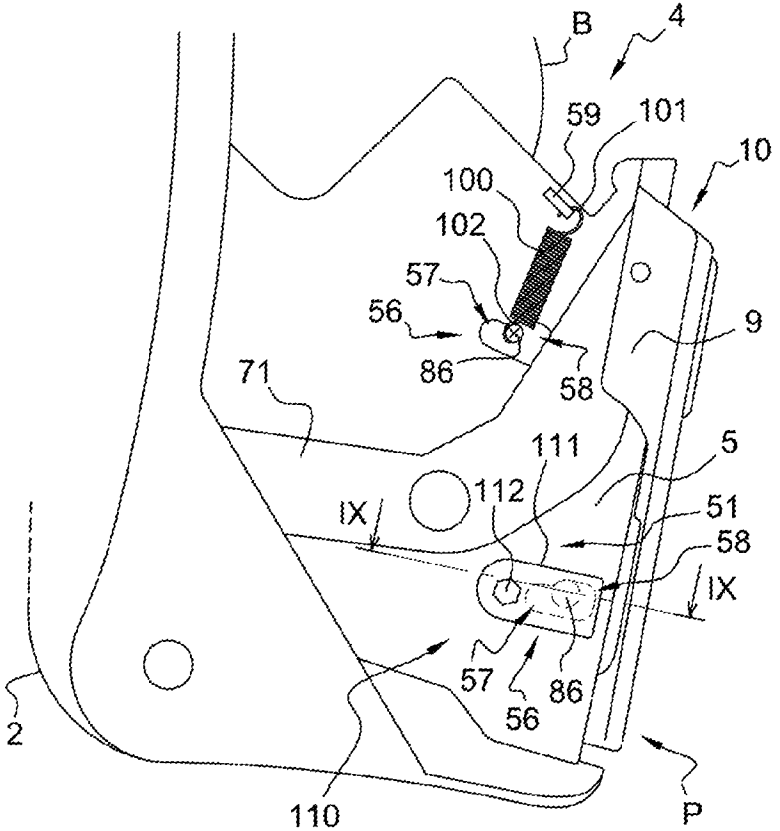
FIG. 7 is a right-side view of the dispenser.
Figure 9:
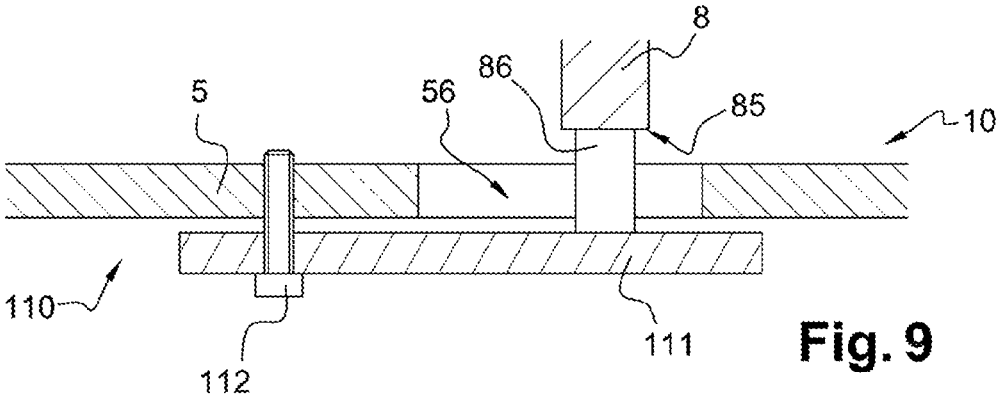
FIG. 9 is a section along line IX-IX in FIG. 7, showing a transverse adjustment device.
Figure 10:
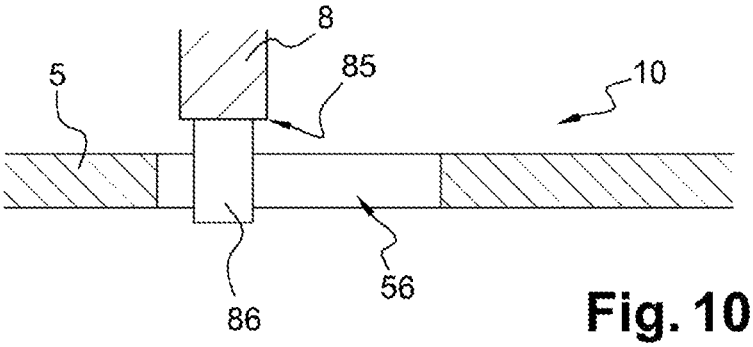
FIG. 10 is a section along line X-X in FIG. 8.

Represented in FIGS. 1 to 10 is a dispenser 1 of precut wiping material, in the form of a reel B unwindable in a strip S.

The overall operation of the dispenser 1 is described for example in FR2986957. The characteristics of the invention itself are detailed in the following.

For purposes of reference in space, a vertical direction is defined from top to bottom, a longitudinal direction is defined from front to back, and a transverse direction is defined from left to right.

The dispenser 1 comprises a housing 2, a cover 3 and a module 4. The housing 2 is intended to be attached to a support, such as a wall. The housing 2 defines a receptacle for receiving the module 4. The cover 3 is articulated at the bottom on the housing 2. The cover 3 is movable relative to the housing 2 between an open position and a closed position. The module 4 is positioned in the housing 2 when the cover 3 is in the open position. The module 4 is partially covered by the cover 3 in the closed position. An outlet passage P, intended for the dispensing the strip S out of the dispenser 1, is then defined at the lower part of the module 4.

The module 4 comprises two side walls 5, a guiding device 6, a pulling device 7, a flap 8 and a front plate 9. A space E for guiding and clamping the strip S is defined between the flap 8 and the plate 9. The space E has a variable configuration depending on the relative position between the flap 8 and the plate 9. The space E is situated immediately upstream from the outlet passage P for the strip S.

The walls 5 are substantially flat and parallel to each other. The reel B is positioned between the walls 5 at the back of the module 4. The reel B is mounted on two stubs, not shown for purposes of simplification. Each wall 5 comprises two receptacles 56, intended to support the flap 8.

The guiding device 6 is intended for guiding the strip S unwound from the reel B between the walls 5 to the space E. The device 6 comprises two side arms 61 and a transverse shaft 62 the ends whereof are supported by the arms 61. The shaft 62 supports the strip S. The arms 61 swing above the walls 5, in such a way that the shaft 62 is movable above the flap 8 and the plate 9, and therefore above the space E.

The pulling device 7 is intended to pull the strip S towards the outlet passage P, through the space E, particularly when the strip S tares too high and is no longer accessible at the passage P. The device 7 comprises two side arms 71 a roller 72, a lever 73, and a mechanism that is not shown for purposes of simplification. The device 7 is described in more detail in FR2986957.

Thanks to the invention, the presence of the device 7 in the module 4 is optional.

The flap 8 is disposed transversely and vertically between the side walls 5. The flap 8 comprises a front surface 81, a rear surface 82, an upper edge 83, a lower edge 84 and two side edges 85. The front surface 81 is disposed facing the plate 9, while the rear surface 82 is disposed facing the reel B. The side edges 85 extends substantially vertically, facing the side walls 5. The lower edge 84 comprises a central opening 87.

Four transverse rods 86 are formed projecting from the side edges 85. More specifically, each edge 85 comprises two separated rods 86, situated respectively at the upper part and lower part of the flap 8. The rods 86 are received in the walls 5, which then support the flap 8.

The front surface 81 comprises a rainbow-shaped profile 88, consisting of alternating ridges 881 and troughs 882. Each ridge 881 and each trough 882 extends along an arc on the front surface 81. The profile 88 has two lower ends 883 opening out at the edge 85.

On either side of the opening 87, the flap 8 comprises tips 89 directed towards the front. The tips 89 are intended to promote tearing of the precut strip S. Thus, the user pulling on the strip S takes a single sheet of material, while the rest of the strip S remains in the space E.

As a variant not shown, the tips 89 can be disposed on an additional part, attached to the flap 8 at the opening 87.

According to another variant, the tips 89 can be replaced by an element of sticky material such as an elastomer, locally increasing the friction between the strip S and the flap 8.

The plate 9 is disposed transversely in front of the flap 8 and articulated on the walls 5. The plate 9 is movable relative to the walls 5 between a lowered position and a raised position. The plate 9 comprises a front surface 91, a rear surface 92, an upper edge 93, a lower edge 94 and two side edges 95. When the plate 9 is raised, the front surface 91 is disposed facing the user of the dispenser 1, while the rear surface 92 is disposed facing the flap 8. Hinges 96 are formed between the edges 94 and 95, on either side of the plate 9, for the articulation thereof on the walls 5. The lower edge 94 comprises a central opening 97.

The rear surface 92 comprises a rainbow-shaped profile 98 consisting of alternating ridges 981 and troughs 982. Each ridge 981 and each trough 982 extends along an arc on the rear surface 92. The profile 98 has two lower ends 983 opening out at the edge 85.

On either side of the opening 97, one of the ridges 981 has an increasing width at each of the ends 983. Said ridge 981 thus forms a tip 983 directed towards the flap 8. Like the tips 89, the tips 983 are intended to promote the tearing of the precut strip S. Thus, the user pulling on the strip S takes a single sheet of material, while the rest of the strip S remains in the space E.

As a variant not shown, the tips 983 can be disposed on an additional part, secured to the plate 9 at the opening 97.

According to another variant, the tips 983 can be replaced by an element of sticky material, for example of elastomer, locally increasing the friction between the strip S and the plate 9.

The central openings 87 and 97 are disposed facing each other. When the plate 9 is raised, the openings 87 and 97 delimit the outlet passage P, immediately beneath the space E.

The rainbow-shaped profiles 88 and 98 are complementary. When the plate 9 is raised, the ridges 881 are received in the troughs 982 and the ridges 981 are received in the troughs 882. The profiles 88 and 98 delimit between them the space E for guiding and clamping the strip S.

According to the invention, the module 4 comprises a relative clearance system 10 between the flap 8 and the plate 9, varying the configuration of the space E for guiding and clamping the strip S.

The clearance system 10 comprises the four receptacles 56 made in the walls 5 and the four rods 86 formed projecting from the edges 85 of the flap 8. Each receptacle 56 receives one of the rods 86.

Each receptacle 56 has a non-circular cross-section. More specifically, each receptacle 56 has an L-shaped section, with a longitudinal part 57 and a vertical part 58. Thus, a clearance is defined between each rod 86 and the inner edge of the respective receptacle 56, longitudinally as well as vertically.

Consequently, the flap 8 has a longitudinal mobility and a vertical mobility between the walls 5. Said mobilities are limited by the abutment contact between the rods 86 and the edges of the receptacles 56.

The clearance system 10 further comprises two springs 100 disposed on each side of the module 4, against the outer surface of the walls 5. Each spring 100 has an upper end 101 and a lower end 102. The end 101 is hooked to a prominence 59 formed on the walls 5, while the end 102 is hooked to one of the rods 86 of the flap 8.

The springs 100 are positioned at an angle. The springs 100 exert a force tending to return the flap 8 upward and forward, thus vertically and longitudinally narrowing the space E defined between the flap 8 and the plate 9.

As a variant not shown, the springs 100 are positioned longitudinally. The springs 100 then exert a force tending to return the flap 8 forward, and thus longitudinally narrow the space E.

According to another variant not shown, the springs 100 are positioned vertically. The springs 100 then exert a force tending to return the flap 8 upwards, and thus vertically narrow the space E.

According to another variant not shown, the system 10 has no springs 100. In this case, the space E is narrowed by gravity, under the weight of the flap 8 itself.

Preferably, the clearance system 10 comprises an adjustment device 110 for adjusting the transverse position of the flap 8 between the side walls 5.

Since the receptacles 56 pass through the walls 5, the rods 86 can move transversely in the receptacles 56. Thus, the flap 8 has a transverse mobility between the walls 5. Said mobility is limited by the abutment contact between the edges 85 and the walls 5. In other words, the clearance provided between each rod 86 and the corresponding receptacle 56 is also transverse.

The adjustment device 110 can be actuated by an operator. The adjustment device 110 comprises a small plate 111 and a screw 112. The small plate 111 presses on one of the rods 86 of the flap 8. Preferably, the small plate 111 comprises a recessed cavity receiving said rod 86. The screw 112 passes through the small plate 111 and penetrates into the wall 5. From the action of screwing the screw 112 into the wall 5, the small plate 111 presses on the rod 86. The flap 8 is moved transversely, which transversely modifies the space E between the flap 8 and the plate 9.

In practice, the clearance system 10 makes it possible to temporarily narrow the space E defined between the flap 8 and the plate 9, and thus temporarily increase the frictional forces exerted between the strip S, the flap 8 and the plate 9 in said space E, when a user pulls on the strip S. The frictional forces are combined with the pulling force to separate one format from the strip S in the space E. Said format is then pulled by the user at the outlet passage P. Moreover, said frictional forces prevent the strip S from moving back up towards the reel B, by clamping the strip S in the space E.

Figure 11:
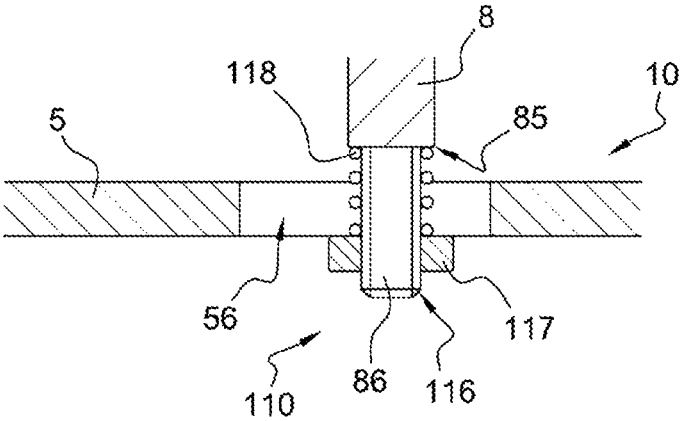
FIG. 11 is a section similar to FIG. 9, showing a variant of the transverse adjustment device.
Figure 12:
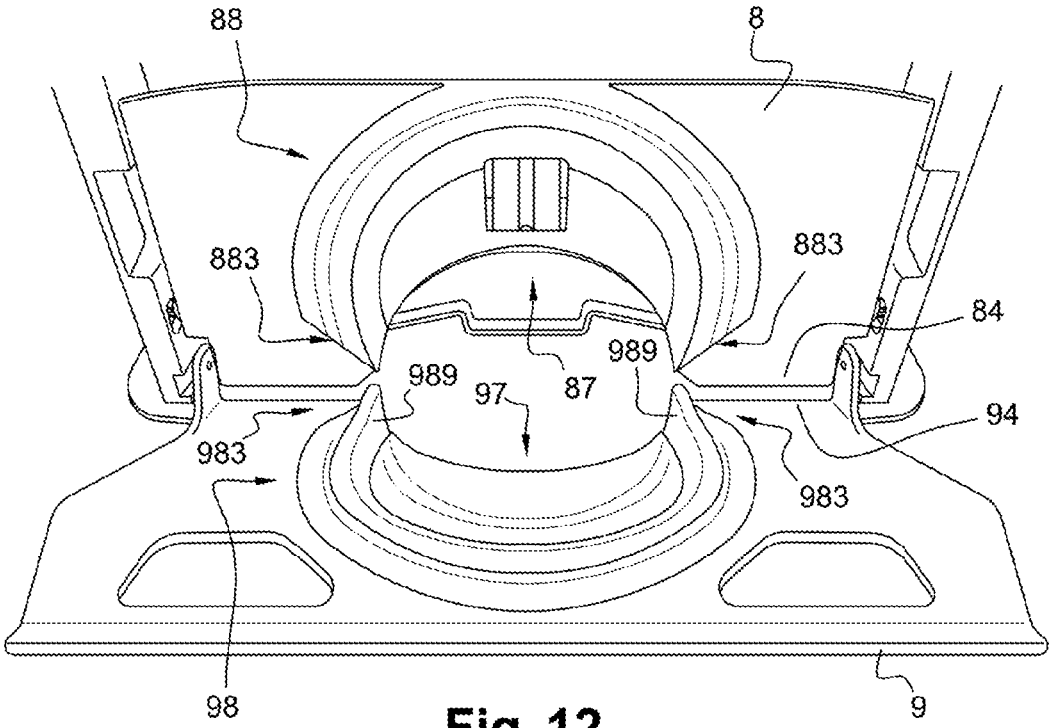
FIG. 12 is a view similar to FIG. 4, showing a flap and plate variant.
Figure 13:
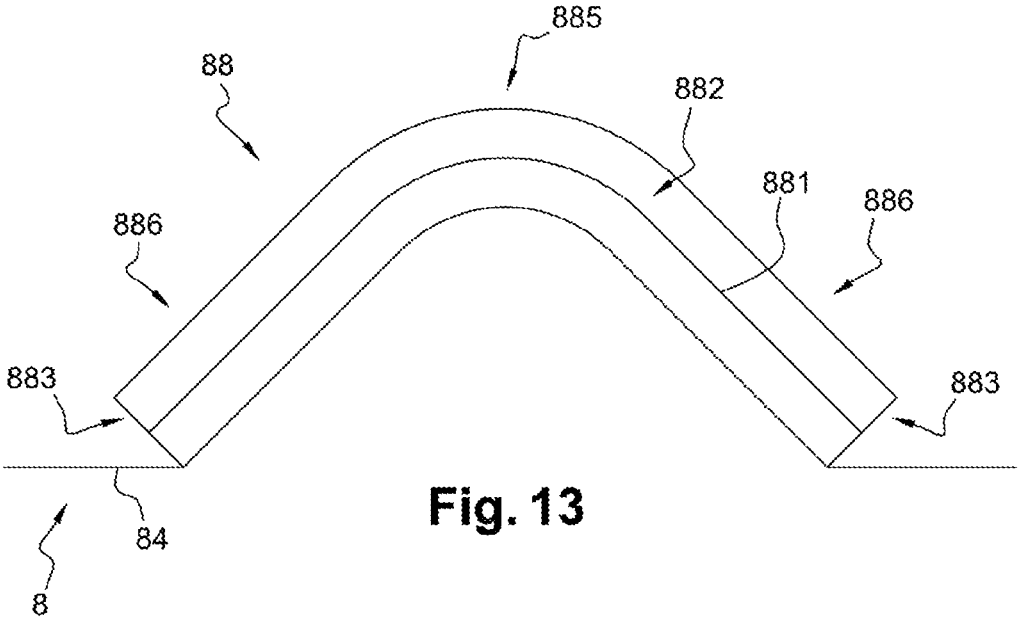
FIG. 13 is a front view showing another flap variant.

Other embodiments of the invention are shown in FIGS. 11 to 13. Some elements that are part of the dispenser 1 are comparable to those of the first embodiment described above, and for purposes of simplification bear the same numerical references.

In FIG. 11, the adjustment device 110 comprises a thread 116 formed on one of the rods 86 of the flap 8, a bolt 117 positioned on said rod 86, and a spring 118 inserted between the bolt 117 and the edge 85 of the flap 8. Through the action of screwing the bolt 117 onto the rod 86, the spring 118 is compressed against the edge 85 and the rod 86 moves transversely. The flap 8 is moved transversely, which transversely modifies the space E between the flap 8 and the plate 9.

In FIG. 12, the lower ends 883 of the rainbow-shaped profile 88 are oriented at 45 degrees and do not open out at the edge 84. Similarly, the lower ends 983 of the rainbow-shaped profile 98 are oriented at 45 degrees and do not open out at the edge 94.

In FIG. 13, showing only the flap 8, the ends 883 are also oriented at 45 degrees. The profile 88 has one curved upper part 885 and two straight upper parts 886.

In the embodiments of FIGS. 12 and 13, the space E has a different configuration, but cutting the strip S at least as effective compared to the first embodiment described above.

In practice, the dispenser 1 can be configured differently from FIGS. 1 to 13 without going outside the scope of the invention. Furthermore, the technical characteristics of the various embodiments and variants mentioned above can be, in whole or for some of them, combined with each other. Thus, the dispenser 1 can be adapted in terms of cost, ergonomics, functionalities and performance.

The invention claimed is:

1. A dispenser of precut wiping material, in the form of a reel that can be unwound as a strip, the dispenser comprising:

a housing, a cover that is movable relative to the housing between an open position and a closed position, and a module received within the housing;

where the module is partially covered by the cover in the closed position, and delimits an outlet passage for the strip of material;

the module comprising:

two side walls parallel to each other, between which the reel is positioned, a guiding device for guiding the strip unwound from the reel, a flap disposed transversely between the side walls, having two side edges that extend facing the side walls, and a front surface comprising a rainbow-shaped profile consisting of ridges and troughs each extending along an arc on the front surface, and a plate disposed transversely in front of the flap, movable relative to the side walls between a lowered position and a raised position, and having a rear surface comprising a rainbow-shaped profile consisting of ridges and troughs each extending along an arc on the front surface;

the rainbow-shaped profile of the flap and the rainbow-shaped profile of the plate being complementary so that the ridges of the flap are received in the troughs of the plate and the ridges of the plate are received in the troughs of the flap when the plate is in the raised position;

the flap and the plate thus delimiting between them a space for guiding and clamping the strip, having a variable configuration, and situated immediately upstream from the outlet passage of the strip;

the module comprising a relative clearance system between the flap and the plate, varying the configuration of the space for guiding and clamping the strip, the clearance system comprising:

four transverse rods formed projecting from the side edges of the flap, with two separated rods per side edge, and four receptacles made in the side walls of the module, with two receptacles per side wall, wherein each receptacle receives one of the rods of the flap and comprises a longitudinal part and a vertical part, a clearance being thus defined longitudinally and vertically between each rod and the corresponding receptacle.

2. The dispenser according to claim 1, wherein the clearance system further comprises two springs disposed on each side of the module, each spring having an upper end hooked to one of the side walls and a lower end hooked to one of the rods, which is received in a receptacle made in said side wall.

3. The dispenser according to claim 2, wherein the springs are positioned at an angle and exert a force tending to return the flap upward and forward, and thus vertically and longitudinally narrow the space defined between the flap and the plate.

4. The dispenser according to claim 2, wherein the springs are positioned longitudinally and exert a force tending to return the flap forward and thus longitudinally narrow the space defined between the flap and the plate.

5. The dispenser according to claim 2, wherein the springs are positioned vertically and exert a force tending to return the flap upward and thus vertically narrow the space defined between the flap and the plate.

6. The dispenser according to claim 1, wherein the clearance system comprises an adjustment device for transverse position adjustment of the flap between the side walls, the adjustment device being actuatable by an operator.

7. The dispenser according to claim 6, wherein the adjustment device comprises:

a small plate pressing against one of the rods of the flap, and a screw that passes through the small plate and penetrates into one of the side walls of the module;

wherein a screwing of the screw into the side wall presses the small plate against the rod, moves the flap and transversely modifies the space defined between the flap and the plate.

8. The dispenser according to claim 6, wherein the adjustment device comprises:

a thread formed on one of the rods of the flap, a bolt positioned on said rod, and a spring inserted between the bolt and one of the side edges of the module, wherein a screwing of the bolt onto the rod compresses the spring, moves the rod and the flap, and transversely modifies the space defined between the flap and the plate.

9. A method of adjusting a dispenser according to claim 6, wherein when an operator positions a new reel in the module, said reel having a thickness, a precut and/or a constituent material different from the preceding reel used in the dispenser, then the operator actuates the adjustment device to narrow or widen the space defined between the flap and the plate, and carries out different pulling tests of the strip at the outlet opening in order to define an optimal pulling force for the strip, said optimal pulling force being a function of the configuration of the space between the flap and the plate.

10. A method of implementing a dispenser according to claim 1, wherein when a user exerts a pulling force on the strip of material at the outlet passage, then frictional forces of friction are exerted between the strip, the flap and the plate in the space for guiding and clamping the strip; said frictional forces, in a first stage, combine with the pulling force to separate a format from the strip, then in a second stage, prevent the strip from moving back up.

* * * * *